US009653250B2

(12) United States Patent
Turyanskiy et al.

(10) Patent No.: US 9,653,250 B2
(45) Date of Patent: May 16, 2017

(54) X-RAY SOURCE

(71) Applicant: LLP "ANGSTREM", Karaganda (KZ)

(72) Inventors: Alexander Georgievich Turyanskiy, Moscow (RU); Serik Kasimovich Kozhakhmetov, Almaty (KZ); Alexander Nikolaevich Rodich, Moskovskaya oblast (RU); Vadim Eval'dovich Skvortcov, Moskovskaya oblast (RU); Roman Abramovich Khmelnitskiy, Moscow (RU)

(73) Assignee: LLP "ANGSTREM", Karaganda (KZ)

( * ) Notice: Subject to any disclaimer, the term of this patent is extended or adjusted under 35 U.S.C. 154(b) by 2 days.

(21) Appl. No.: 14/741,709

(22) Filed: Jun. 17, 2015

(65) Prior Publication Data

US 2015/0371808 A1 Dec. 24, 2015

(30) Foreign Application Priority Data

Jun. 18, 2014 (RU) ..... 2014124797

(51) Int. Cl.

| | |
|---|---|
| ***H01J 35/08*** | (2006.01) |
| ***H01J 35/18*** | (2006.01) |
| ***H05G 1/00*** | (2006.01) |
| ***G21K 1/02*** | (2006.01) |
| *G21K 1/06* | (2006.01) |

(52) U.S. Cl.

CPC ..... *H01J 35/08* (2013.01); *G21K 1/02* (2013.01); *H01J 35/18* (2013.01); *H05G 1/00* (2013.01); *G21K 1/06* (2013.01); *H01J 2235/088* (2013.01); *H01J 2235/18* (2013.01); *H01J 2235/186* (2013.01)

(58) Field of Classification Search

USPC ..... 378/206, 140

See application file for complete search history.

(56) References Cited

U.S. PATENT DOCUMENTS

| | | | |
|---|---|---|---|
| 5,081,663 | A | 1/1992 | Gerlach et al. |
| 5,475,729 | A | 12/1995 | Mattson et al. |
| 7,023,954 | B2 | 4/2006 | Rafaeli et al. |

(Continued)

FOREIGN PATENT DOCUMENTS

| | | |
|---|---|---|
| RU | 2 106 619 C1 | 3/1998 |

*Primary Examiner* — Phillip A Johnston

(74) *Attorney, Agent, or Firm* — Muncy, Geissler, Olds & Lowe, P.C.

(57) ABSTRACT

An X-ray source with optical indication of radiation, which can be used in various measuring devices for parameters control and visualization of structure of industrial and biological objects, is proposed. The source comprises a vacuum housing, an anode irradiated by electrons and generating the divergent flux of radiation, an exit window for X-ray radiation, means for optical indication of X-ray radiation beam including a source of optical radiation and an optical mirror. The anode is made composite in the form of a thin film and a radiolucent substrate luminescent in the optical range. The anode structure is an exit window of the source, and behind it the coaxially arranged means of collimation and focusing of X-ray and optical radiation and means of optical visualization of X-ray focus are mounted. The proposed device significantly increases the accuracy and informativity of optical indication of X-ray radiation parameters.

4 Claims, 2 Drawing Sheets

(56) References Cited

U.S. PATENT DOCUMENTS

| | | | | |
|---|---|---|---|---|
| 7,469,040 | B2 * | 12/2008 | Holm | G21K 5/02 378/136 |
| 8,406,378 | B2 * | 3/2013 | Wang | H01J 35/08 378/121 |
| 2003/0063707 | A1 * | 4/2003 | Mulhollan | H01J 9/025 378/134 |
| 2007/0195933 | A1 | 8/2007 | Bogojevic et al. | |

* cited by examiner

X-RAY SOURCE

The invention relates to X-ray engineering, more specifically, to X-ray sources with optical indication of radiation, and can be used in various measuring devices for parameters control and visualization of structure of industrial and biological objects.

X-ray sources with optical indication provide information about the presence of x-ray radiation and the location of the radiation beam, which allows to improve the accuracy of measurements, convenience of work and operation safety. An X-ray source comprising an anode irradiated by the electron beam and means for optical indication of X-ray radiation is known [1]. The said means of optical indication include fluorescent in the optical range foil located on the periphery of the divergent beam of radiation, and an optical waveguide providing the external output of optical radiation flux from the zone of X-ray irradiation. The disadvantage of the above-mentioned device is low informativity since the proposed arrangement provides only signals about the presence or absence of X-ray beam.

Also known is an X-ray source [2] comprising an anode irradiated by electrons and generating the divergent flux of radiation, and means for optical indication of X-ray radiation including a radiolucent optical mirror located outside the window to exit the X-ray radiation, and a laser. The laser radiation reflected by the mirror allows to indicate the location of the X-ray beam axis on the object of control. The main disadvantage of this device is the errors of alignment of optical and X-ray beams directions, occurring due to accidental displacement of elements of the optical and X-ray arrangement or due to their thermal drift. Another disadvantage of this device is the impossibility to control the intensity and location of the X-ray focus during operation of the source.

The closest technical solution to the claimed invention is the X-ray source described in [3] The designated device comprises an anode irradiated by electrons and generating the divergent flux of radiation, an exit window for X-ray radiation, means for optical indication of X-ray radiation beam including a source of optical radiation and an optical mirror located behind the exit window of the X-ray source housing, coaxially arranged means of collimation and focusing of X-ray and optical radiation. The disadvantages of this device are as follows. The sources of optical and X-ray radiation and the trajectories of the optical and X-ray radiation coincide with the collimation system in the form of polycapillary and a mirror. When the axis of polycapillary deviates at a small angle from a predetermined direction, the X-ray beam passage through the collimation system can be disturbed. However, a small angular misalignment has little effect on the optical radiation passage through the said collimation system. Thus, the erroneous optical indication of the presence of the probing X-ray beam is possible. The intensity of optical radiation is determined mainly by brightness of an optical source and is independent of the energy and current of the electrons irradiating the anode of the source. It does not allow to control the intensity of X-ray radiation passed through the collimation system. In addition, with such arrangement of elements it is impossible to determine the position and size of the X-ray focus, that impedes the adjustment of the device.

The object of the present invention is to improve the accuracy and informativity of optical indication of X-ray radiation parameters.

This object is achieved in that in the X-ray source comprising the anode irradiated by electrons and generating the divergent radiation flux, an exit window for X-ray radiation, means of optical indication of the X-ray beam, including a source of optical radiation and an optical mirror located outside the exit window of the X-ray source, coaxially arranged means of collimation and focusing of X-ray and optical radiation, the anode is composite in the form of a thin film and an optically-transparent and radiolucent substrate luminescent in the optical range, with the substrate being the exit window of the X-ray source, and the optical mirror is located off-axis X-ray beam in the region of divergent radiation flux generated by the anode.

This object is also achieved in that the radiolucent substrate is made of an optically activated synthetic diamond crystal.

This object is also achieved in that the means of collimation and focusing of X-ray and optical radiation are made of radiolucent plastic material, such as polycarbonate.

This object is also achieved in that the X-ray source further comprises means of visualization of the anode image reflected by the optical mirror.

The chief matter of the proposed technical solution is as follows. The anode of the x-ray source is made composite in the form of a thin film and an optically-transparent and radiolucent substrate luminescent in the optical range. Upon irradiation of the said anode with a beam of electrons the optical and X-ray foci turn out to be spatially coincided. The luminescent substrate is optically transparent and is the exit window of the X-ray source. This provides the possibility of direct control by means of reflecting mirrors and video surveillance of the location and size of the X-ray focus and the intensity of X-ray radiation.

The operation of the device is illustrated by FIGS. 1, 2.

Figure 1:
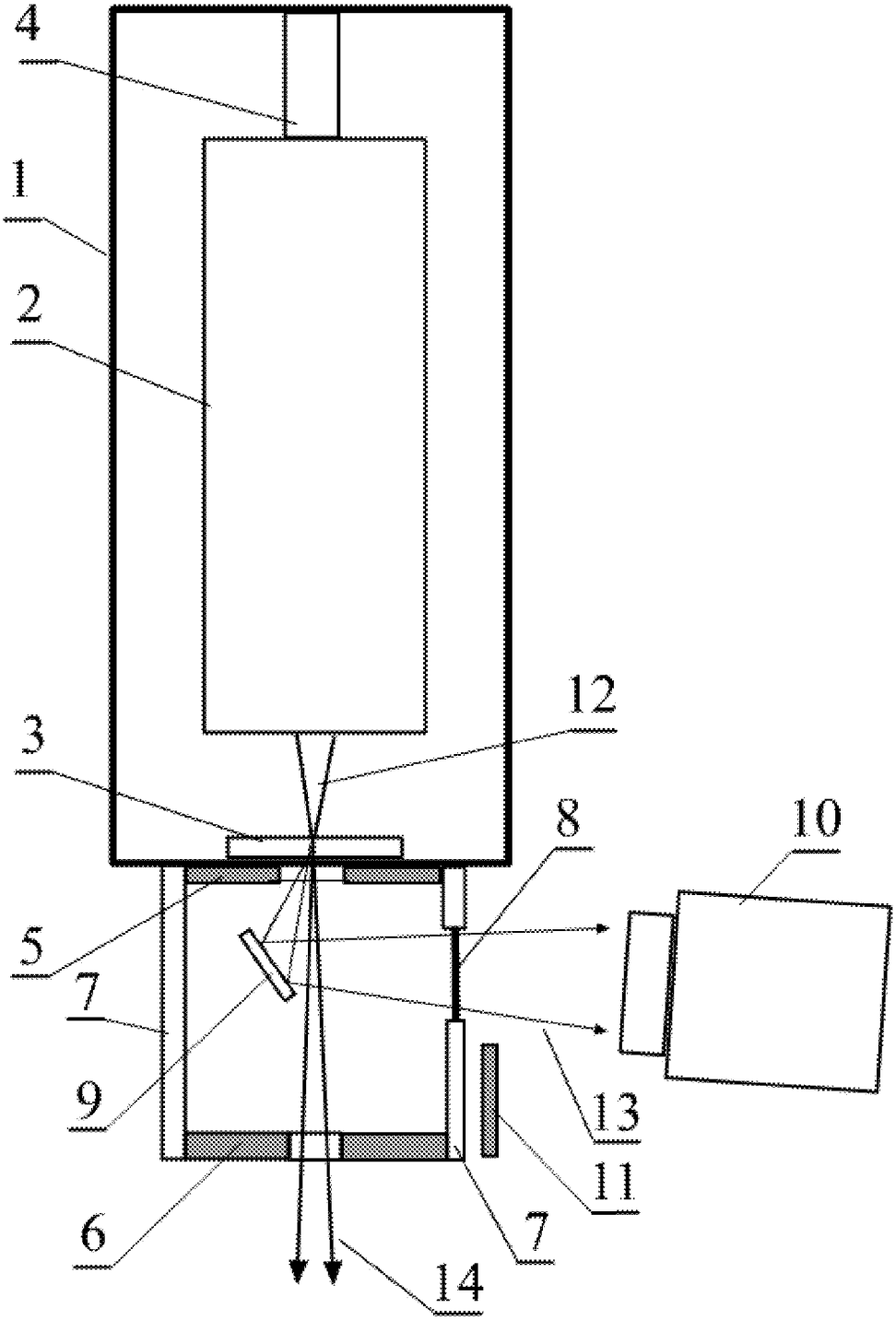
FIG. 1 shows a perspective view of an X-ray emitter.

The X-ray emitter (see FIG. 1) comprises a housing 1 made of glass or ceramics, a unit 2 of focusing of electrons, an anode 3, a cathode assembly 4, diaphragms 5, 6, a protective housing 7, an exit optical window 8, an optical mirror 9, a video camera 10 and a protective screen 11. The diaphragms 5, 6, the protective housing 7 and the screen 11 are made of absorbing X-ray radiation material, such as tantalum. The unit 2 of focusing of electrons, the anode 3, the cathode assembly 4 are in vacuum. High voltage accelerating the electrons is applied between the anode 3 and the cathode assembly 4. The anode 3 (see FIG. 2) is composite in the form of a radiolucent substrate whose surface is coated with a layer of metal. The substrate is predominantly an optically transparent diamond plate with a thickness of about 300 μm, providing at radiation with energy of >10 keV, the transmittance factor T>80%. The thickness of the metal layer is chosen depending on the maximum energy of electrons $E_m$. For example, at $E_m \approx 40$ keV the thickness of the metal layer of molybdenum is chosen equal to 0.8-1 μm.

In more detail the design and principle of operation of the anode assembly are considered later.

The device operates in the following way. The cathode assembly 4 emits a flow of electrons. By means of a system of electrostatic lenses located at unit 2, the electron beam 12 is formed, which focuses on the surface of the anode 3 in the spot size of 25-50 microns. In contact with the thin-film anode 3 a part of the high-energy electrons passes through the metal layer 15 and creates an excitation area 17 located both in the metal layer 15 and the substrate 16. Thus, the metal layer generates X-ray radiation 14, and the activated volume of the substrate generates optical radiation 13. When using a synthetic diamond as a substrate, optical activation providing a bright light in the optical range, is carried out by way of pre-irradiation of the substrate by electrons with energy of ~1 MeV.

This scheme of generation provides spatial alignment of the foci of X-ray radiation 14 and optical radiation 13. Therefore, the trajectories of optical and X-ray beams passed through the diaphragms 5, 6 are also spatially coincided that allows to visualize the X-ray radiation and the irradiated region on the object of control. In this respect, the change of the electron current at a fixed accelerating voltage between the anode 3 and the cathode assembly 4 proportionally changes the light intensity of the source in the optical and x-ray ranges, allowing to determine the intensity of X-ray radiation. Control can be carried out visually or by registering the optical radiation flux reflected from the optical mirror 9, by means of a photodetector or video camera 10 located opposite to the exit optical window 8. Also, the video camera 10 provides additional control of the position and size of the X-ray focus. This allows to determine continuously the said parameters directly in the process of the source operation. During adjustment of the visualization system the protective screen 11 is mounted in front of the diaphragm 6 opening.

Figure 2:
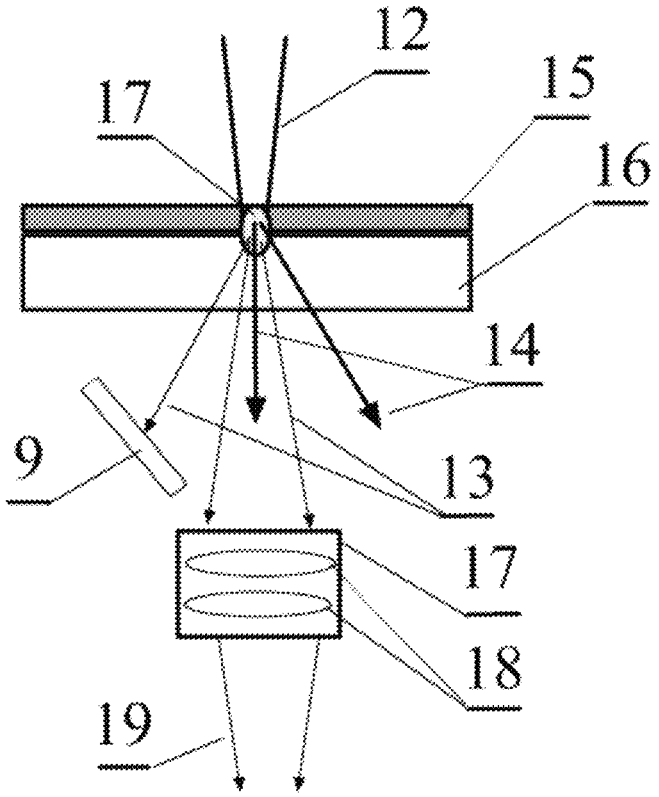
FIG. 2 shows the anode assembly of the X-ray emitter.

An embodiment of the collimation system is shown in FIG. 2. The optical unit 17 containing radiolucent plastic lenses 18 is mounted along the path of optical beam 13 and X-ray beam 14. The unit 17 is positioned in the center of the diaphragm 6, which ensures the coaxiality of the beams. Lenses 18 are made, for example, of polycarbonate which has high radiation resistance. The use of lenses allows to form a convergent optical beam, which creates a bright focal spot of small size on the surface of the object of control. This facilitates the use of the source during low power generation of radiation. Thus, during the source operation the possibility of erroneous indication of X-ray beam presence is excluded.

REFERENCES

1. U.S. Pat. No. 5,081,663 G01D 18/00 (1992). X-ray apparatus with beam indicator.
2. Patent of Russia No. 2106619 G01N 23/00 (1998). Лазерный центратор для рентгеновского излучателя .
3. U.S. Pat. No. 7,023,954 B2 G01N 23/223 (2006). Optical alignment of X-ray microanalyzers.

The invention claimed is:

1. An X-ray source with optical indication of X-ray radiation comprising:

an X-ray source housing with an exit window wherein the exit window comprises an anode assembly having a radiolucent substrate and a metal layer, wherein the metal layer is partially transparent for high energy electrons and the radiolucent substrate is transparent in optical range and fluoresces under the influence of high energy electrons;

a cathode assembly that creates electron flow irradiating the anode assembly;

a system of electrostatic lenses that focus electrons irradiating the anodes, and generating a divergent flux of radiation, wherein said electrons simultaneously create excitation areas in said radiolucent substrate and said metal layer, from which divergent fluxes of optical and X-ray radiation, respectively are generated;

a first diaphragm and a protective housing having;

an optical mirror located behind the exit window of the X-ray source housing, coaxially arranged means of collimation and focusing of X-ray and optical radiation, wherein the optical mirror is located off-axis from the X-ray beam in the region of divergent radiation flux generated by the anode, and an exit optical window through which a camera provides the optical indication of X-ray radiation.

2. The X-ray source according to claim 1 wherein the radiolucent substrate is made of an optically activated synthetic diamond crystal.

3. The X-ray source according to claim 1 wherein the means of collimation and focusing of X-ray and optical radiation are made of radiolucent plastic material, such as polycarbonate.

4. The X-ray source according to claim 1 wherein it further comprises means of visualization of the anode image reflected by the optical mirror.

* * * * *